US012740594B2

(12) United States Patent
Liu et al.

(10) Patent No.: US 12,740,594 B2
(45) Date of Patent: Sep. 22, 2026

(54) VAPORIZER AND ELECTRONIC VAPORIZATION DEVICE

(71) Applicant: SHENZHEN FIRST UNION TECHNOLOGY CO., LTD., Shenzhen City (CN)

(72) Inventors: Haitao Liu, Shenzhen City (CN); Wei Xu, Shenzhen City (CN); Zhongli Xu, Shenzhen City (CN); Yonghai Li, Shenzhen City (CN)

(73) Assignee: SHENZHEN FIRST UNION TECHNOLOGY CO., LTD., Shenzhen City (CN)

( * ) Notice: Subject to any disclaimer, the term of this patent is extended or adjusted under 35 U.S.C. 154(b) by 387 days.

(21) Appl. No.: 18/037,336

(22) PCT Filed: Nov. 17, 2021

(86) PCT No.: PCT/CN2021/131240
§ 371 (c)(1),
(2) Date: May 17, 2023

(87) PCT Pub. No.: WO2022/105801
PCT Pub. Date: May 27, 2022

(65) Prior Publication Data

US 2023/0404158 A1 Dec. 21, 2023

(30) Foreign Application Priority Data

Nov. 17, 2020 (CN) ..... 202011284262.7

(51) Int. Cl.
*A24F 40/485* (2020.01)
*A24F 40/10* (2020.01)
(Continued)

(52) U.S. Cl.
CPC ..... *A24F 40/485* (2020.01); *A24F 40/10* (2020.01); *A24F 40/42* (2020.01); *A24F 40/44* (2020.01); *A24F 40/46* (2020.01)

(58) Field of Classification Search
None
See application file for complete search history.

(56) References Cited

U.S. PATENT DOCUMENTS

2013/0319407 A1* 12/2013 Liu ..... A24F 40/485 128/202.21
2018/0125117 A1* 5/2018 DeMeritt ..... A61M 15/002
2020/0113243 A1 4/2020 Novak, III et al.

FOREIGN PATENT DOCUMENTS

CA 3127014 A1 9/2020
CN 104720114 A 6/2015
(Continued)

*Primary Examiner* — Linda L Gray
(74) *Attorney, Agent, or Firm* — Scully, Scott, Murphy & Presser, P.C.

(57) ABSTRACT

A vaporizer includes a liquid storage cavity, a liquid absorbing element, a first support member located between the liquid absorbing element and the liquid storage cavity in a longitudinal direction, at least partially defining a vaporization chamber surrounding the liquid absorbing element; a heating element configured to heat at least a part of the liquid substrate of the liquid absorbing element to generate an aerosol; and a vapor output channel, including a through hole extending in the longitudinal direction on the first support member, where the first support member is provided with a blocking part located between the heating element and the through hole, and the blocking part at least partially covers the heating element in the longitudinal direction; the blocking part is provided with a side opening, and at least a part of the vaporization chamber is in airflow communication with the vapor output channel through the side opening.

13 Claims, 7 Drawing Sheets

(51) Int. Cl.

| | |
|---|---|
| ***A24F 40/42*** | (2020.01) |
| ***A24F 40/44*** | (2020.01) |
| ***A24F 40/46*** | (2020.01) |

(56) References Cited

FOREIGN PATENT DOCUMENTS

| | | | |
|---|---|---|---|
| CN | 209931493 | U | 1/2020 |
| CN | 210432832 | U | 5/2020 |
| CN | 210747230 | U | 6/2020 |
| CN | 210869884 | U | 6/2020 |
| CN | 111657547 | A | 9/2020 |
| CN | 211672451 | U | 10/2020 |
| CN | 211746948 | U | 10/2020 |
| CN | 211746950 | U | 10/2020 |
| CN | 214431781 | U | 10/2021 |
| EP | 2614731 | A1 | 7/2013 |
| KR | 10-2017-0124305 | A | 11/2017 |

* cited by examiner

VAPORIZER AND ELECTRONIC VAPORIZATION DEVICE

CROSS-REFERENCE TO RELATED APPLICATIONS

This application is a 35 U.S.C. § 371 National Phase conversion of International (PCT) Patent Application No. PCT/CN2021/131240, filed on Nov. 17, 2021, which claims priority to Chinese Patent Application No. 202011284262.7, entitled "VAPORIZER AND ELECTRONIC VAPORIZATION DEVICE" and filed with the China National Intellectual Property Administration on Nov. 17, 2020, which is incorporated herein by reference in its entirety. The PCT International Patent Application was filed and published in Chinese.

TECHNICAL FIELD

Embodiments of this application relate to the field of electronic vaporization devices, and in particular, to a vaporizer and an electronic vaporization device.

BACKGROUND

Tobacco products (such as cigarettes and cigars) burn tobacco during use to produce tobacco smoke. Attempts are made to replace these tobacco-burning products by making products that release compounds without burning.

An example of this type of products is a heating device that releases compounds by heating rather than burning materials. For example, the materials may be tobacco or other non-tobacco products. These non-tobacco products may include or not include nicotine. As another example, there are aerosol-providing products, for example, electronic vaporization devices. These devices usually contain vaporizable liquid, and the liquid is heated to be vaporized, so as to generate an inhalable aerosol.

Known electronic vaporization devices usually use a heating element combined with a liquid absorbing element to heat a liquid substrate absorbed by the liquid absorbing element through capillary infiltration to generate an aerosol. During use of the above electronic vaporization devices, a temperature of a contact region between the liquid absorbing element and the heating element is high, and vaporization of the liquid substrate is therefore smooth. A part of the liquid absorbing element away from the heating element has a low temperature and a large amount of liquid substrate. As a result, vaporization is not enough, forming an aerosol with droplets of a large particle size and producing a sizzling sound (commonly known as "e-liquid explosion"), and the generated aerosol containing large droplets is directly outputted from a vapor output channel, which degrades inhalation experience.

SUMMARY

An embodiment of this application provides a vaporizer, including an outer housing, the outer housing having a longitudinal direction and a horizontal direction perpendicular to the longitudinal direction, where the outer housing is internally provided with:

a liquid storage cavity, configured to store a liquid substrate;

a liquid absorber, extending in the horizontal direction, and constructed to be in fluid communication with the liquid storage cavity to absorb the liquid substrate;

a first supporter, located between the liquid absorber and the liquid storage cavity in the longitudinal direction, and at least partially defining a vaporization chamber surrounding the liquid absorber;

a heater, combined with the liquid absorber and configured to heat at least a part of the liquid substrate of the liquid absorber to form and release an aerosol to the vaporization chamber; and a vapor output channel, configured to output the aerosol in the vaporization chamber and including a through hole extending in the longitudinal direction on the first supporter, where:

the first supporter is provided with a blocking part located between the heater and the through hole;

the blocking part is provided with a side opening, and at least a part of the vaporization chamber is in airflow communication with the vapor output channel through the side opening; and the side opening is opposite to at least a part of the heater in the longitudinal direction.

The above vaporizer blocks large droplets formed by e-liquid explosion by using the blocking part to cover the heater.

In a preferred implementation, the blocking part covers at least a part of the heater in the longitudinal direction.

In a preferred implementation, the side opening is located at a central part of the outer housing in the horizontal direction; and/or, the side opening is opposite to a central part of the heater in the horizontal direction.

In a preferred implementation, the vaporizer further includes a thickness direction perpendicular to the longitudinal direction and the horizontal direction; and the side opening is constructed to extend in the thickness direction.

In a preferred implementation, an extension length of the blocking part in the thickness direction covers the liquid absorber and/or the heater.

In a preferred implementation, the blocking part is not in contact with the heater and/or the liquid absorber.

In a preferred implementation, an area of a projection of the blocking part in the through hole in the longitudinal direction is less than two-thirds of an area of the through hole.

In a preferred implementation, the heater is constructed to extend in the horizontal direction and at least partially surrounds the liquid absorber; and a size of the side opening in the horizontal direction is less than two-thirds of an extension length of the liquid absorber.

In a preferred implementation, a side of the blocking part close to the side opening in the thickness direction is an opening.

In a preferred implementation, a first protruding edge surrounding the side opening is formed on a surface of the blocking part close to the heater, to prevent the liquid substrate on a surface of the blocking part from flowing to the side opening.

In a preferred implementation, the first supporter is provided with a keeper extending out toward the liquid absorber, and the keeper keeps the liquid absorber; and a hook-shaped or groove-shaped space is formed between the first protruding edge and the keeper, to collect the liquid substrate flowing from a gap between the first supporter and the liquid absorber to the side opening.

In a preferred implementation, a second protruding edge surrounding the side opening is formed on a surface of the blocking part close to the through hole, to prevent an aerosol condensate dropping from an inner wall of the vapor output channel from flowing to the side opening.

In a preferred implementation, the outer housing is further internally provided with:

a second supporter, located at a side of the liquid absorber away from the first supporter in the longitudinal direction and at least partially keeping the liquid absorber, where the second supporter and the first supporter define the vaporization chamber.

In a preferred implementation, one of the first supporter and the second supporter is rigid, and the other is flexible.

This application further provides an electronic vaporization device, including a vaporizer for vaporizing a liquid substrate to generate an aerosol, and a power supply component for supplying power to the vaporizer, where the vaporizer includes the foregoing vaporizer.

BRIEF DESCRIPTION OF THE DRAWINGS

One or more embodiments are exemplarily described with reference to the corresponding figures in the accompanying drawings, and the descriptions do not constitute a limitation to the embodiments. Components in the accompanying drawings that have same reference numerals are represented as similar components, and unless otherwise particularly stated, the figures in the accompanying drawings are not drawn to scale.

DETAILED DESCRIPTION

For ease of understanding of this application, this application is described in more detail below with reference to the accompanying drawings and specific implementations.

Figure 1:
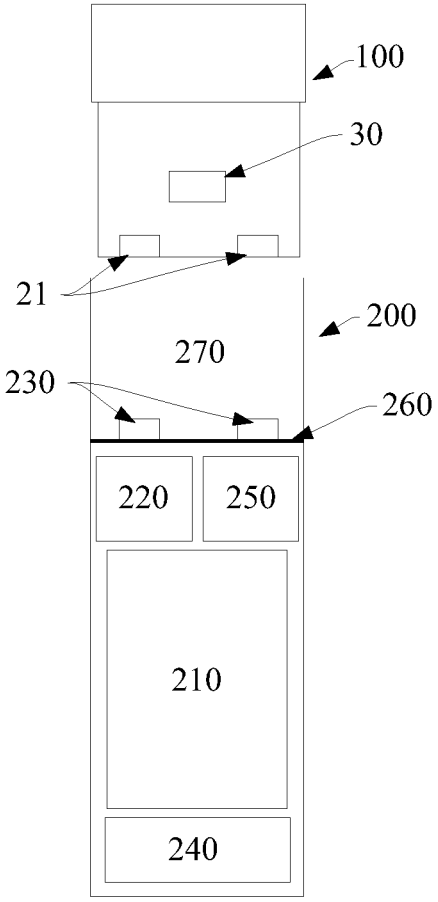
FIG. 1 is a schematic structural diagram of an electronic vaporization device according to an embodiment of this application.

An embodiment of this application provides an electronic vaporization device. Referring to FIG. 1, the electronic vaporization device includes: a vaporizer 100 configured to store a liquid substrate and vaporize the liquid substrate to generate an aerosol, and a power supply mechanism 200 configured to supply power to the vaporizer 100.

In an optional implementation, for example, as shown in FIG. 1, the power supply mechanism 200 includes a receiving cavity 270, arranged at an end in a length direction and configured to receive and accommodate at least a part of the vaporizer 100; and a first electrical contact 230, at least partially exposed on a surface of the receiving cavity 270, and configured to be electrically connected to the vaporizer 100 to supply power to the vaporizer 100 when at least a part of the vaporizer 100 is received and accommodated in the power supply mechanism 200.

According to a preferred implementation shown in FIG. 1, a second electrical contact 21 is arranged on an end portion of the vaporizer 100 opposite to the power supply mechanism 200 in the length direction, so that when the at least a part of the vaporizer 100 is received in the receiving cavity 270, the second electrical contact 21 is in contact with and abuts against the first electrical contact 230 to form an electrical connection.

A sealing element 260 is arranged in the power supply mechanism 200, and at least a part of an internal space of the power supply mechanism 200 is separated by the sealing element 260 to form the receiving cavity 270. In the preferred implementation shown in FIG. 1, the sealing element 260 is constructed to extend in a cross-sectional direction of the power supply mechanism 200, and is prepared by a flexible material, so as to prevent the liquid substrate seeping from the vaporizer 100 to the receiving cavity 270 from flowing to a controller 220, a sensor 250, and other components in the power supply mechanism 200.

In the preferred implementation shown in FIG. 1, the power supply mechanism 200 further includes a cell 210 close to another end opposite to the receiving cavity 270 in the length direction for supplying power; and a controller 220, arranged between the cell 210 and an accommodating cavity, and operably guiding a current between the cell 210 and the first electrical contact 230.

During use, the power supply mechanism 200 includes a sensor 250, configured to sense an inhalation flow generated by using a suction nozzle cover 20 of the vaporizer 100 during inhalation, so that the controller 220 controls the cell 210 to output a current to the vaporizer 100 according to a detection signal of the sensor 250.

Further, in the preferred implementation shown in FIG. 1, a charging interface 240 is provided on another end of the power supply mechanism 200 away from the receiving cavity 270, and is configured to supply power to the cell 210 after being connected to an external charging device.

Figure 2:
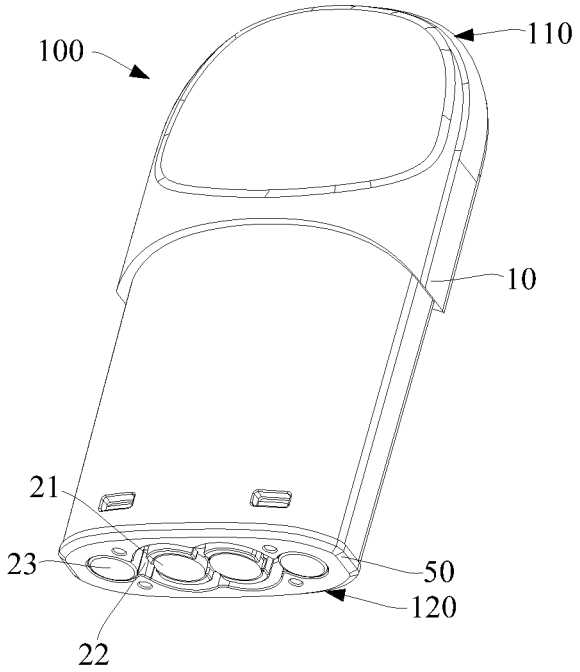
FIG. 2 is a schematic structural diagram of a vaporizer in FIG. 1 according to an embodiment.

FIG. 2 is a schematic diagram of a specific structure of the vaporizer 100 according to an embodiment of this application. In this embodiment, the whole vaporizer 100 is in an elongated and flat shape, and has a proximal end 110 and a distal end 120 facing away from each other in the length direction. During use, the proximal end 110 is used as an end for a user to inhale, and the distal end 120 is an end received in the power supply mechanism 200. An outer structure of the vaporizer 100 includes:

a main housing 10, in a hollow cylindrical shape, where an end portion close to the distal end 120 is an opening; and an end cap 50 configured as a second supporter, arranged at the distal end 120 of the vaporizer 100 and closing the opening of the main housing 10, to form a complete shell of the vaporizer 100 together.

Further, according to FIG. 2, the second electrical contact 21 of the vaporizer 100 passes from the distal end 120 to the inside, and is at least partially exposed on a surface of the end cap 50, so as to form an electrical connection with the power supply mechanism 200 during use. In addition, the distal end 120 of the vaporizer 100 is further provided with an air inlet 22, to allow external air to enter the vaporizer 100 during inhalation by the user.

In addition, the vaporizer 100 further includes a magnetic element 23 passing from the distal end 120 to the inside, which is magnetically attracted to the power supply mechanism 200 to keep the vaporizer 100 stable in the power supply mechanism 200 during use.

Figure 3:
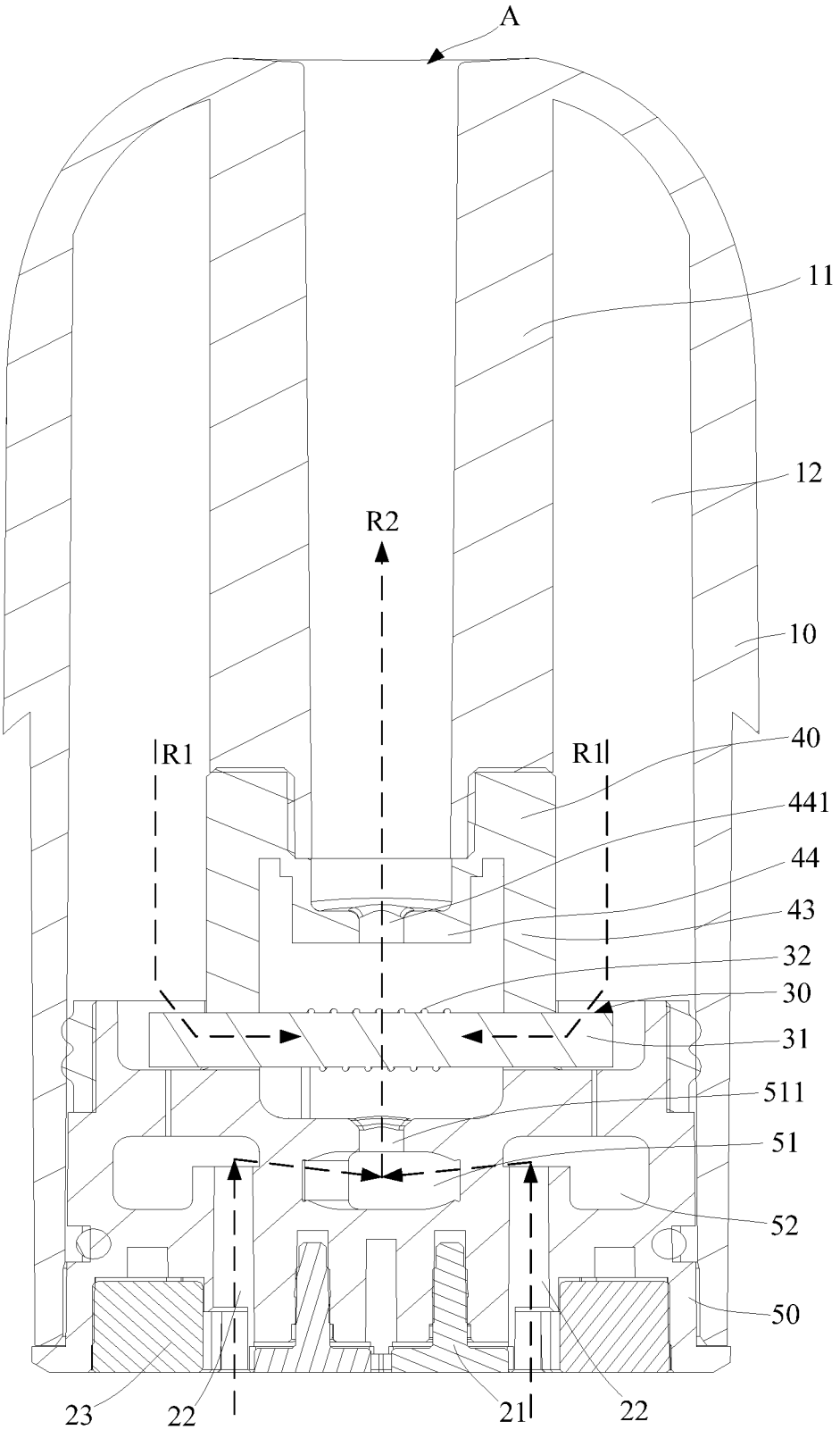
FIG. 3 is a schematic cross-sectional view of the vaporizer in FIG. 2 in a width direction.
Figure 4:
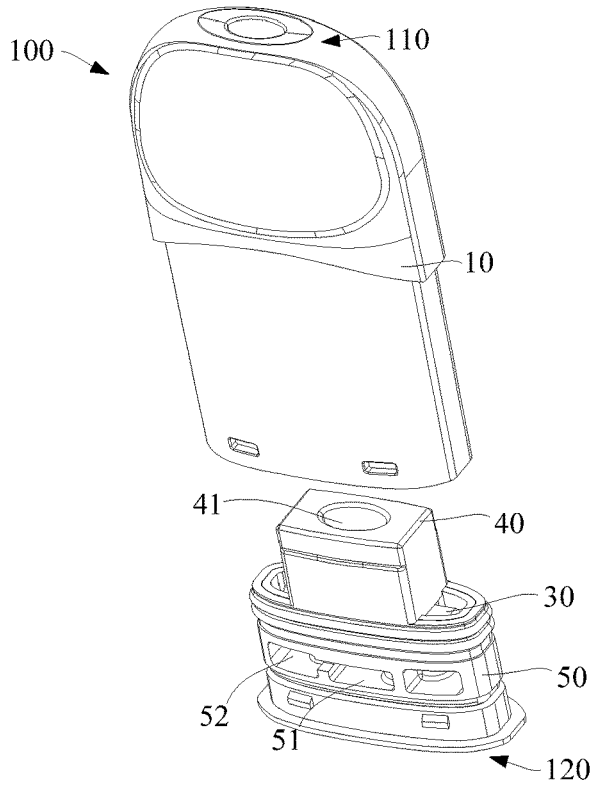
FIG. 4 is a schematic exploded view of components of the vaporizer in FIG. 3 before assembly.
Figure 5:
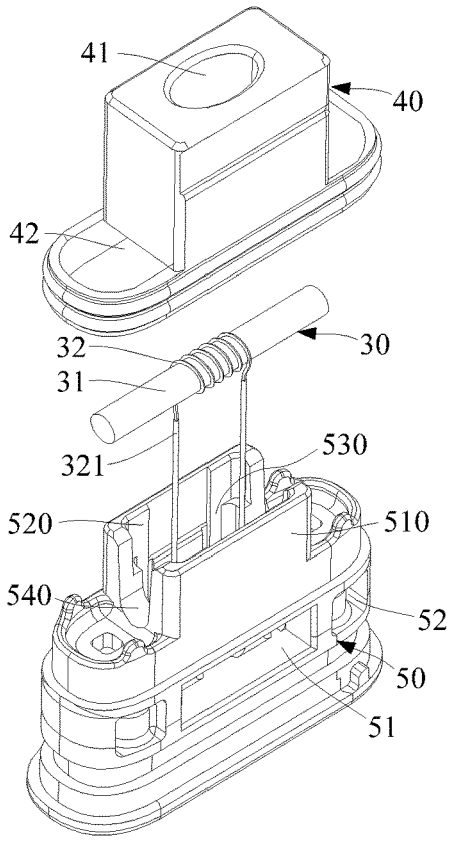
FIG. 5 is a schematic exploded view of a sealing element, a vaporization assembly, and an end cap in FIG. 4.

Further, FIG. 3 to FIG. 5 are a schematic diagram of an internal structure of the vaporizer 100 in FIG. 2 and schematic exploded views of components of the vaporizer 100 in FIG. 2. According to FIG. 3 and FIG. 4, the vaporizer 100 further includes:

a vapor output channel 11, extending in an axial direction of the main housing 10, where an upper end of the vapor output channel is in airflow communication with a suction nozzle A located at an upper end of the main housing 10, so as to output the aerosol generated in the vaporizer 100 to the suction nozzle A for inhalation;

a liquid storage cavity 12, formed by a space between the vapor output channel 11 and an inner wall of the main housing 10, and configured to store the liquid substrate; and a vaporization assembly 30, configured to absorb the liquid substrate from the liquid storage cavity 12 by capillary infiltration and heat and vaporize the absorbed liquid substrate to generate an aerosol for inhalation. Specifically, the vaporization assembly 30 includes a liquid absorber 31, and a heater 32 at least partially surrounding the liquid absorber 31. According to FIG. 3 and FIG. 4, the liquid absorber 31 is constructed to extend in a width direction of the main housing 10 with two ends exposed or in fluid communication with the liquid storage cavity 12, and the liquid substrate in the liquid storage cavity 12, along an arrow R1 in FIG. 3, is transmitted inward after being absorbed by the two ends of the liquid absorber 31. At least a part of the heater 32 surrounding or winding the liquid absorber 31 is configured to heat at least a part of the liquid substrate in the liquid absorber 31 to generate an aerosol for inhalation.

In an optional implementation, the liquid absorber 31 may be made of or include a porous ceramic body, fibrous cotton, fibrous rope, a porous material, and the like; and the heater 32 may be made of a resistive metal material, such as iron, nickel, chromium, or an alloy thereof.

Further, referring to FIG. 3 to FIG. 5, the end cap 50 and a flexible sealing element 40 configured as a first supporter assemble and fix the vaporization assembly 30 in the main housing 10. After assembly, the end cap 50 and the sealing element 40 clamp and keep the vaporization assembly 30 together. Specifically, referring to FIG. 5, the rigid end cap 50 is provided with a first wall 510 and a second wall 520 extending in the length direction, where the first wall 510 and the second wall 520 are disposed opposite to each other and separately close to two sides of the main housing 10 in the thickness direction, and a vaporization chamber 530 is formed between the first wall 510 and the second wall 520; and a support groove 540 located at two ends of the first wall 510 and the second wall 520 and configured to support the liquid absorber 31. According to FIG. 5, the support groove 540 is generally U-shaped.

After assembly, the liquid absorber 31 and the heater 32 are mainly accommodated in the vaporization chamber 530 to release the generated aerosol to the vaporization chamber 530, and the aerosol is outputted by the vaporization chamber 530 through an air tube insertion hole 41 on the sealing element 40 to the vapor output channel 11.

The two ends of the heater 32 are further in contact with the second electrical contact 21 through an elongated pin or a wire 321, so that the second electrical contact 21 supplies power to the heater 32.

The sealing element 40 further covers outside the first wall 510 and the second wall 520 of the end cap 50, and clamps or compresses the liquid absorber 31 from above in FIG. 5 after assembly, so that the vaporization assembly 30 is stably kept between the sealing element 40 and the end cap 50.

Generally, in an optional implementation, the sealing element 40 is prepared by using a flexible material, such as silicone and rubber. The air tube insertion hole 41 is also provided on the sealing element 40. During assembly, a lower end of the vapor output channel 11 is inserted into the air tube insertion hole 41 to be in communication with the vaporization chamber 530, so as to output the aerosol in the vaporization chamber 530 to the suction nozzle A for inhalation. During use, the sealing element 40 is configured to prevent the liquid substrate in the liquid storage cavity 12 from entering the vapor output channel 11 and the vaporization chamber 530, so that the liquid substrate can only leave the liquid storage cavity 12 through being absorbed by the liquid absorber 31.

Further, referring to FIG. 5, each side of the sealing element 40 in the width direction is provided with a via 42. Therefore, after the liquid absorber 31 is clamped or compressed, at least a part of the liquid absorber 31 can pass the via 42 to extend into the liquid storage cavity 12 or be exposed, so as to form fluid communication with the liquid storage cavity 12.

Further, for a design of an airflow of the e-cigarette vaporizer 100, reference may be made to FIG. 3 and FIG. 4. The end cap 50 is provided with a main air chamber 51, and a buffer air chamber 52 located at two sides of the main air chamber 51 in the width direction and in communication with the main air chamber 51. The buffer air chamber 52 is in direct airflow communication with the air inlet 22, so that the external air enters the buffer air chamber 52 from the air inlet 22, then enters the main air chamber 51 from the buffer air chamber 52, and is eventually outputted to the vapor output channel 11 from an air outlet hole 511 between the main air chamber 51 and the vaporization chamber 530 through the vaporization chamber 530, forming a complete inhalation airflow as indicated by an arrow R2 in FIG. 3.

Figure 6:
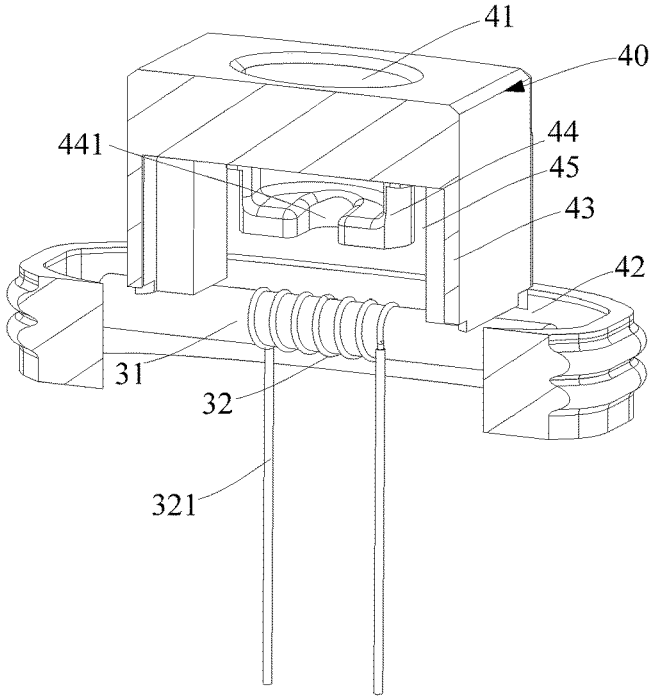
FIG. 6 is a schematic cross-sectional view of the sealing element and the vaporization assembly in FIG. 5 after assembly.

Further, referring to FIG. 6, the sealing element 40 includes a keeper 43 extending out toward the liquid absorber 31, and the liquid absorber 31 is kept on the end cap 50 by the keeper 43 in a clamping or compressing manner.

Figure 7:
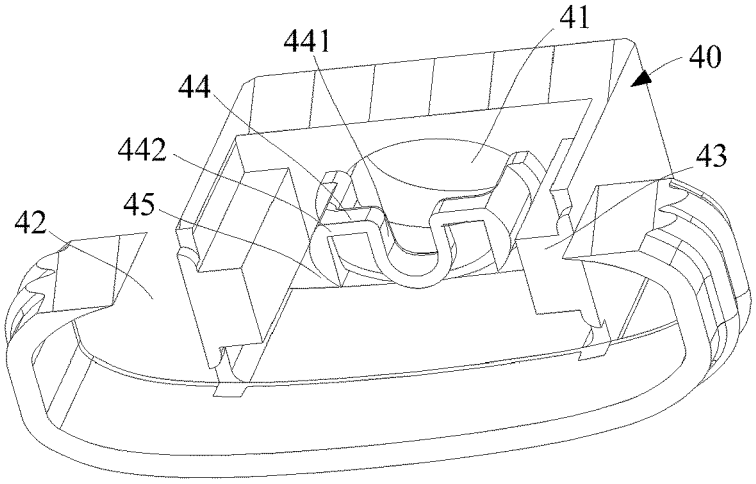
FIG. 7 is a schematic cross-sectional view of the sealing element in FIG. 5 from another perspective.
Figure 8:
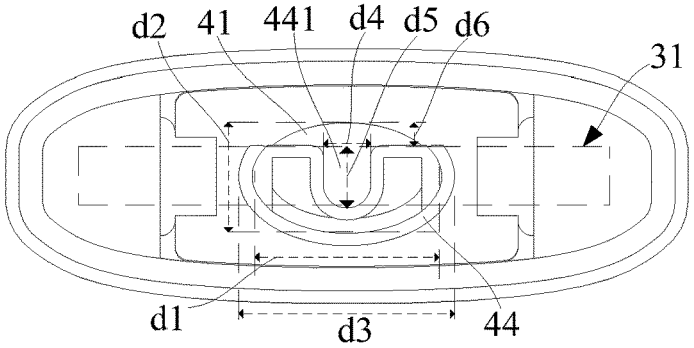
FIG. 8 is a schematic bottom view of the sealing element in FIG. 5.

Referring to FIG. 6 to FIG. 8, the sealing element 40 further includes a blocking part 44 located between the vaporization assembly 30 and the air tube insertion hole 41. The blocking part 44 is mainly configured to prevent large droplets produced by e-liquid explosion in a non-central high-temperature region of the liquid absorber 31 from entering the air tube insertion hole 41. The blocking part 44 is provided with a U-shaped side opening 441 facing a side in the thickness direction. The U-shaped side opening 441 is located at a central position in the width direction, for the aerosol to flow to the vapor output channel 11. According to FIG. 7, a side of the blocking part 44 in the thickness direction is open, and another side is closed, so as to facilitate output of the vapor, which is conducive to reduce large inhalation resistance caused by the airflow outputted from the small-size side opening 441.

Further, referring to FIG. 7, the blocking part 44 is further provided with a protruding edge 442 surrounding the U-shaped side opening 441, and the protruding edge 442 forms a hook-like blocking structure, which also prevents the droplets from flowing to the U-shaped side opening 441 along a surface of the blocking part 44.

Referring to FIG. 8 and FIG. 5, in a detailed design of the product, an edge of an opening side of the blocking part 44 is directly aligned with an edge of the liquid absorber 31, so that an orthographic projection of the blocking part 44 as shown in FIG. 8 can fully cover the liquid absorber 31 in the thickness direction after assembly. In addition, in a size design, the air tube insertion hole 41 is in an elliptical shape and has a length d1 of 6.8 mm and a width d2 of 4.2 mm. An extension length of the heater 32 in the form of a spiral coil is slightly less than the length of the air tube insertion hole in design, which is 6.5 mm.

According to FIG. 8, a length d3 of the blocking part 44 is 7.5 mm, which is slightly greater than the length d1 of the air tube insertion hole 41, and fully covers the length of the heater 32. A width d4 of the U-shaped side opening 441 is 2.2 mm in size design, and an extension length d5 is 3.4 mm.

In FIG. 8, a spacing d6 is kept between an outer edge of an upper side of the blocking part 44 and the air tube insertion hole 41, without fully covering the air tube insertion hole 41, and the spacing d6 is 1 mm in design.

Using the above size design, on the blocking part 44, only a part of the U-shaped side opening 441 located at the central position exposes the heater 32, and other parts all cover the heater 32; and a length of the heater 32 exposed by the U-shaped side opening 441 is 2.2 mm, ignoring error sizes of production and assembly, which accounts for ⅓ of the length of the heater 32, and at least less than ½ of the length of the heater 32. Basically, large droplets generated by e-liquid explosion is prevented as much as possible in a non-high temperature concentrated region.

In addition, the spacing d6 between the outer edge of the upper side of the blocking part 44 and the air tube insertion hole 41 causes the blocking part 44 to non-fully cover the air tube insertion hole 41. An area of the air tube insertion hole 41 exposed by the spacing d6 and the U-shaped side opening 441 is greater than ⅓ of an area of the air tube insertion hole 41 and close to ½, ensuring suitable inhalation resistance.

Figure 9:
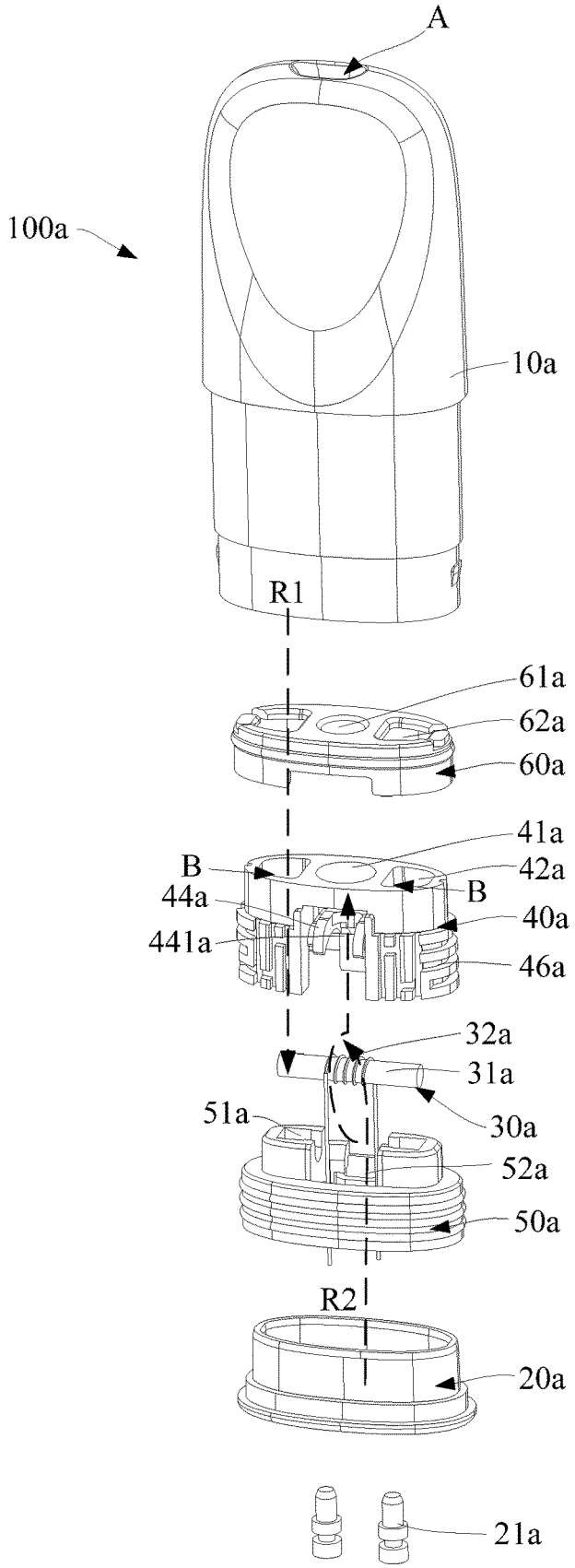
FIG. 9 is a schematic exploded view of parts of the vaporizer in FIG. 1 according to another embodiment.

FIG. 9 is a schematic structural diagram of a vaporizer 100*a* according to another embodiment of this application, whose structure includes:

- a main housing 10*a*, provided with a suction nozzle A at an upper end, and in a hollow cylindrical shape with a lower end opening, where similar to the embodiment shown in FIG. 3, the main housing 10*a* is also provided with a vapor output tube (not shown) extending in an axial direction of the main housing 10*a*, to output an aerosol generated in the vaporizer 100*a* to the suction nozzle A;
- an end cap 20*a*, arranged on the lower end opening of the main housing 10*a;*
- a liquid storage cavity, defined by a space between the main housing 10*a* and the vapor output tube, and configured to store a liquid substrate; and
- a vaporization assembly 30*a*, configured to absorb the liquid substrate from the liquid storage cavity and heat and vaporize the absorbed liquid substrate to generate an aerosol for inhalation. Specifically, the vaporization assembly 30*a* includes a liquid absorber 31*a* extending in a width length of the main housing 10*a*, and a heater 32*a* at least partially surrounding the liquid absorber 31*a* and heating a part of the liquid substrate of the liquid absorber 31*a* to generate an aerosol. Two ends of the liquid absorber 31*a* are in fluid communication with the liquid storage cavity 12*a*, the liquid substrate in the liquid storage cavity 12*a*, along an arrow R1 in FIG. 9, is transmitted inward after being absorbed by the two ends of the liquid absorber 31*a*. Similarly, the vaporizer 100*a* further includes a second electrical contact 21*a* configured to supply power to the heater 32*a*.

For ease of sealing the liquid storage cavity and keeping the vaporization assembly the main housing 10*a* is further internally provided with:

- a rigid holder 40*a* and a flexible support base 50*a* sequentially arranged in a longitudinal direction of the main housing 10*a*, where the rigid holder 40*a* is close to the liquid storage cavity, and the flexible support base 50*a* is kept on the end cap 20*a*, and a vaporization chamber 70*a* surrounding the vaporization assembly 30*a* and formed between the rigid holder 40*a* and the flexible base 50*a* after assembly, where the vaporization assembly 30*a* is located between the rigid holder 40*a* and the flexible support base 50*a*, and is clamped or kept by the rigid holder 40*a* and the flexible support base 50*a* in the vaporization chamber 70*a*, so as to release the generated aerosol to the vaporization chamber 70*a* during use.

In addition, the rigid holder 40*a* is provided with a first insertion hole 41*a*, for an end portion of a vapor output channel 11*a* to be inserted into the first insertion hole 41*a*. At least a part of a surface of the rigid holder 40*a* is covered by a sealing element 60*a*, so as to seal a gap between the rigid holder 40*a* and the main housing 10*a* to prevent the liquid substrate in the liquid storage cavity from seeping from the gap.

To cooperate with liquid guide and assembly of the rigid holder 40*a*, the sealing element 60*a* is provided with a first liquid guide hole 62*a* for the liquid substrate to flow to the rigid holder 40*a*, and a second insertion hole 61*a* for the vapor output tube to pass through, where the vapor output tube is inserted into the first insertion hole 41*a* after passing through the second insertion hole 61*a*. In addition, the sealing element 60*a* further seals a gap between the rigid holder 40*a* and the first insertion hole 41*a* to prevent the liquid substrate in the liquid storage cavity from seeping from the gap into the vapor output tube.

According to the arrow R1 in FIG. 9, the rigid holder 40*a* is further provided with a second liquid guide hole 42*a*. During use, the liquid substrate in the liquid storage cavity 12*a* is transmitted to the vaporization assembly 30*a* to be absorbed and vaporized through the first liquid guide hole 62*a* and the second liquid guide hole 42*a* sequentially.

Figure 10:
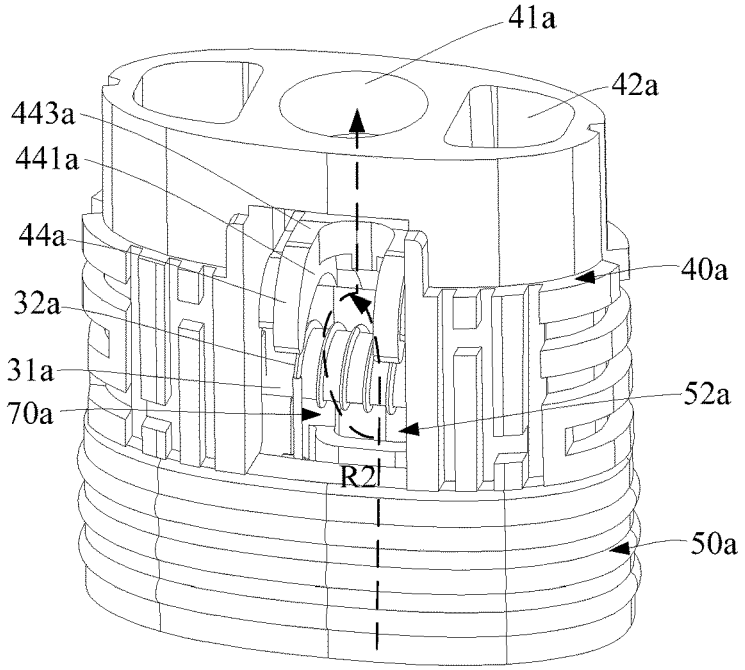
FIG. 10 is a schematic diagram of a rigid holder, a vaporization assembly, and a support base in FIG. 9 after assembly.
Figure 11:
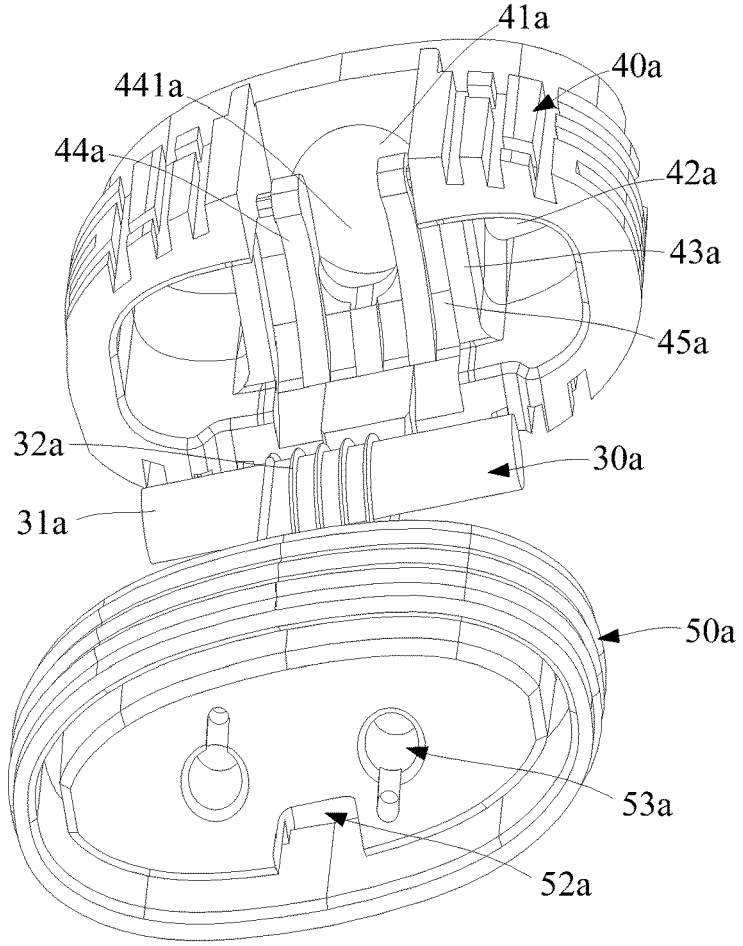
FIG. 11 is a schematic exploded view of the rigid holder, the vaporization assembly, and the support base in FIG. 10 from a perspective.

Referring to FIG. 10 and FIG. 11, a side of the flexible support base 50*a* is provided with an air inlet channel 52*a*, for external air to enter the vaporization chamber 70*a* between the rigid holder 40*a* and the flexible support base 50*a* through an air inlet on the end cap 20*a* and the air inlet channel 52*a*.

Further, referring to FIG. 10 and FIG. 11, the rigid holder 40*a* is provided with a keeper 43*a* extending out toward the vaporization assembly 30*a*, and compresses or keeps the vaporization assembly 30*a* between the rigid holder 40*a* and the flexible support base 50*a* through the keeper 43*a*.

As shown in FIG. 10 and FIG. 11, the rigid holder 40*a* further includes a blocking part 44*a* located at a center and opposite to the first insertion hole 41*a*. A specific spacing is reserved between the blocking part 44*a* and the first insertion hole 41*a*, to block large droplets generated by e-liquid explosion in a region deviating from the center of the liquid absorber 31*a*. The blocking part 44*a* is provided with a U-shaped side opening 441*a* facing a side in a thickness direction. The aerosol generated in the vaporization chamber 70*a* is directly outputted through the U-shaped side opening 441*a* to the first insertion hole 41*a*.

According to FIG. 11, the blocking part 44*a* is further provided with a retention groove 45*a* extending in the thickness direction, to prevent liquid collected on a surface from flowing to the first insertion hole 41*a*.

Figure 12:
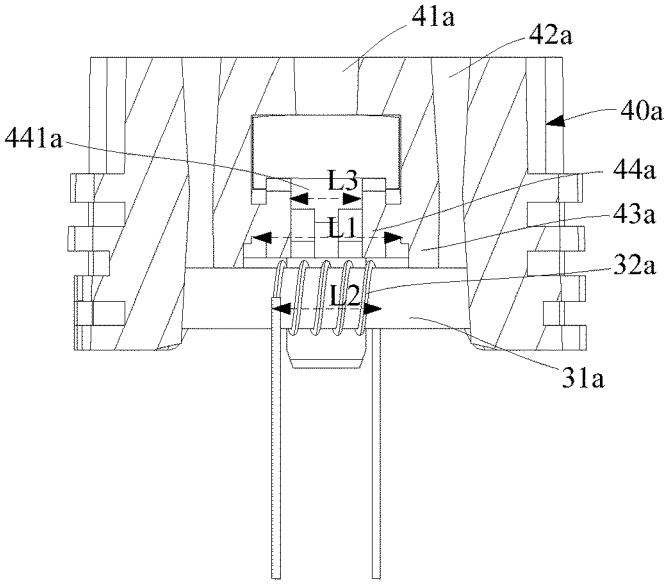
FIG. 12 is a schematic cross-sectional view of the rigid holder and the vaporization assembly in FIG. 9 after assembly.
Figure 13:
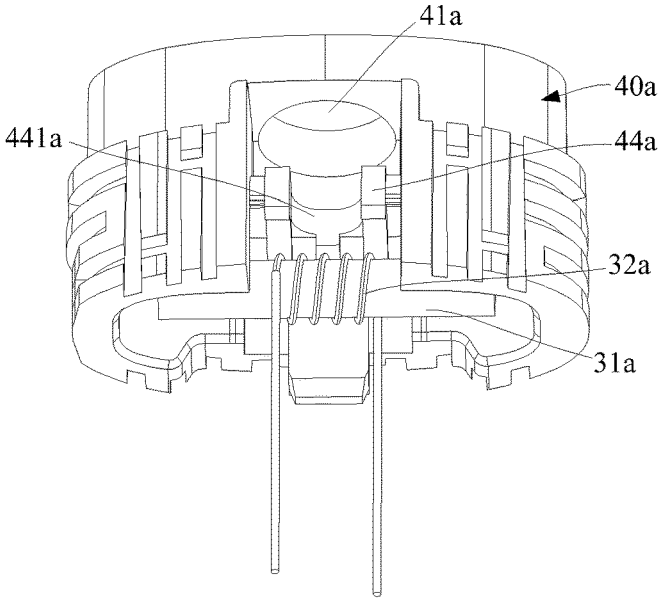
FIG. 13 is a schematic diagram of the rigid holder and the vaporization assembly in FIG. 12 after assembly from another perspective.

States of the rigid holder 40*a* and the vaporization assembly 30*a* after assembly are shown in FIG. 12 and FIG. 13. The first insertion hole 41*a* is in a shape of a round hole, and an inner diameter is designed to be 4.2 mm; and a width L1 of the blocking part 44*a* is slightly greater than the inner diameter of the first insertion hole 41*a*, which is 4.4 mm.

In this embodiment, an extension length L2 of the used heater 32*a* in the form of a spiral coil is less than the extension length in the previous embodiment, which is about 4 mm; and a width L3 of the U-shaped side opening 441*a* is slightly greater than the width in the previous embodiment, and in FIG. 12, the width L3 of the U-shaped side opening 441*a* is 2.6 mm.

Figure 14:
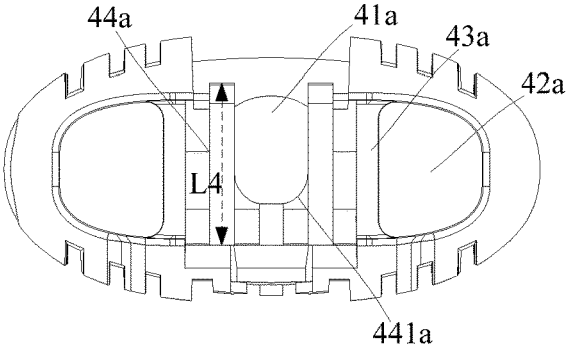
FIG. 14 is a schematic structural diagram of a bottom view of the rigid holder in FIG. 9.

In this embodiment, a bottom view of the rigid holder 40*a* is shown in FIG. 14. An extension length L4 of the blocking part 44*a* in the thickness direction is greater than the inner diameter of the first insertion hole 41*a* and fully covers the first insertion hole 41*a*, and the spacing d6 in the embodiment of FIG. 8 does not exist. According to an implementation of FIG. 14, only the U-shaped side opening 441*a* exposes a part of the first insertion hole 41*a*, and an area of the exposed first insertion hole 41*a* is about 9.04 $mm^2$ through calculation, accounting for less than ⅔ of an area of the first insertion hole 41*a*, which is 13.85 $mm^2$, reserving an enough area to maintain suitable inhalation resistance.

In the preferred implementation, a length of the heater 32*a* in the form of a spiral coil exposed by the U-shaped side opening 441*a* is 2.6 mm, accounting for 65% of a central line total length of the heater 32*a*, which is close to and less than ⅔ of a total length of the heater 32*a*. In addition, the blocking part 44*a* can basically block and cover parts of the heater 32*a* close to two end portions.

Further, in a preferred implementation shown in FIG. 10, a surface of the blocking part 44*a* facing the first insertion hole 41*a* is also provided with protruding edges 443*a* protruding opposite to each other, to prevent an aerosol condensate dropping from an inner wall of the vapor output tube above from falling into the side opening 441*a*. Several capillary grooves 46*a* extending in a circumferential direction or in a length direction are further formed on an outer surface of the rigid holder 40*a*. According to FIG. 9 and FIG. 10, the capillary grooves 46*a* are in airflow communication with the vaporization chamber 70*a* and a groove-shaped space formed between the protruding edge 443*a* and the keeper 43*a*, so as to absorb and keep a condensate in an airflow or a condensate dropping from the vapor output channel.

It should be noted that, the specification of this application and the accompanying drawings thereof illustrate preferred embodiments of this application, but are not limited to the embodiments described in this specification. Further, a person of ordinary skill in the art may make improvements or modifications according to the above description, and such improvements and modifications shall all fall within the protection scope of the appended claims of this application.

What is claimed is:

1. A vaporizer, comprising an outer housing, the outer housing having a longitudinal direction and a horizontal direction perpendicular to the longitudinal direction, wherein the outer housing is internally provided with:

a liquid storage cavity, configured to store a liquid substrate;

a liquid absorber, extending in the horizontal direction, and constructed to be in fluid communication with the liquid storage cavity to absorb the liquid substrate;

a first supporter, located between the liquid absorber and the liquid storage cavity in the longitudinal direction, and at least partially defining a vaporization chamber surrounding the liquid absorber;

a heater, combined with the liquid absorber and configured to heat at least a part of the liquid substrate of the liquid absorber to form and release an aerosol to the vaporization chamber; and a vapor output channel, configured to output the aerosol in the vaporization chamber and comprising a through hole extending in the longitudinal direction on the first supporter, wherein:

the first supporter is provided with a blocking part located between the heater and the through hole;

the blocking part is provided with a side opening, and at least a part of the vaporization chamber is in airflow communication with the vapor output channel through the side opening; and the side opening is opposite to at least a part of the heater in the longitudinal direction;

the side opening overlaps a central axis of the outer housing in the horizontal direction; and/or the side opening faces a central point of the heater in the horizontal direction; and/or the side opening overlaps a central axis of the vapor output channel.

2. The vaporizer according to claim 1, wherein the blocking part covers at least a part of the heater in the longitudinal direction.

3. The vaporizer according to claim 1, wherein the vaporizer further comprises a thickness direction perpendicular to the longitudinal direction and the horizontal direction; and the side opening is constructed to extend in the thickness direction.

4. The vaporizer according to claim 3, wherein an extension length of the blocking part in the thickness direction covers the liquid absorber and/or the heater.

5. The vaporizer according to claim 1, wherein the blocking part is not in contact with the heater and/or the liquid absorber.

6. The vaporizer according to claim 1, wherein an area of a projection of the blocking part in the through hole in the longitudinal direction is less than two-thirds of an area of the through hole.

7. The vaporizer according to claim 1, wherein the heater is constructed to extend in the horizontal direction and at least partially surrounds the liquid absorber; and a size of the side opening in the horizontal direction is less than two-thirds of an extension length of the liquid absorber.

8. The vaporizer according to claim 3, wherein a side of the blocking part next to the side opening in the thickness direction is an opening.

9. The vaporizer according to claim 1, wherein a first protruding edge surrounding the side opening is formed on a surface of the blocking part next to the heater, to prevent the liquid substrate on a surface of the blocking part from flowing to the side opening.

10. The vaporizer according to claim 9, wherein the first supporter is provided with a keeper extending out toward the liquid absorber, and the keeper keeps the liquid absorber; and a groove-shaped space is formed between the first protruding edge and the keeper, to collect the liquid substrate flowing from the surface of the blocking part to the side opening.

11. The vaporizer according to claim 1, wherein a second protruding edge surrounding the side opening is formed on a surface of the blocking part next to the through hole, to prevent an aerosol condensate dropping from an inner wall of the vapor output channel from flowing to the side opening.

12. The vaporizer according to claim 1, wherein the outer housing is further internally provided with:

a second supporter, located at a side of the liquid absorber away from the first supporter in the longitudinal direction and at least partially keeping the liquid absorber, wherein the second supporter and the first supporter define the vaporization chamber.

13. An electronic vaporization device, comprising a vaporizer for vaporizing a liquid substrate to generate an aerosol and a power supply component for supplying power to the vaporizer, wherein the vaporizer comprises the vaporizer according to claim 1.

* * * * *